United States Patent [19]

Patriquin

[11] Patent Number: 4,474,042

[45] Date of Patent: Oct. 2, 1984

[54] MULTISTATION LOCK

[75] Inventor: George P. Patriquin, Gardner, Mass.

[73] Assignee: Three Point Products, Inc., Leominster, Mass.

[21] Appl. No.: 310,648

[22] Filed: Oct. 13, 1981

[51] Int. Cl.[3] ..... E05B 29/02; E05B 35/00

[52] U.S. Cl. ..... 70/337; 70/347; 70/364 R

[58] Field of Search ..... 70/337, 340, 345, 346, 70/347, 364 R, 409, 416, 419

[56] References Cited

U.S. PATENT DOCUMENTS

| | | | |
|---|---|---|---|
| 1,280,633 | 10/1918 | Baird | 70/409 |
| 1,785,634 | 12/1930 | Lawrence | 70/337 |
| 2,580,882 | 1/1952 | Blohm | 70/340 |
| 3,973,421 | 8/1976 | Patriquin | 70/364 R |
| 4,057,987 | 11/1977 | Patriquin | 70/364 R |
| 4,075,879 | 2/1978 | Christopher | 70/337 |
| 4,302,957 | 12/1981 | Wolter | 70/337 |

*Primary Examiner*—Robert L. Wolfe
*Attorney, Agent, or Firm*—Joseph S. Iandiorio

[57] ABSTRACT

A multistation lock including: a housing; a plug rotatable in the housing between a lock position and first and second stations; a keyway in the plug; locking tumbler means for coupling the plug and housing and being biased into a locking position and being movable to a shear position by a proper key in the keyway; and a code track in the housing, the track having a different code segment for each station for engaging a code section of a key shoulder, including a first code segment for the first station for enabling a first key having a code section receivable by the first code segment to move between the lock position and the first station, and a second code segment for the second station for enabling a second key having a code section receivable by the second code segment to move between the lock position and the second station.

17 Claims, 15 Drawing Figures

KEY 'X'

KEY 'A'

KEY P

KEY Z

MULTISTATION LOCK

FIELD OF INVENTION

This invention relates to a multistation lock in which positional code members are independent of the tumbler mechanism.

BACKGROUND OF INVENTION

Early multistation locks obtained rotational control of the plug by means of stop washers that rotated with the plug and engaged stops on the housing so as to limit angular movement of the plug. In one application a stop washer limits movement of the plug in only one direction from the lock position to a single, unlock station circumferentially spaced therefrom, or alternatively allows rotational movement in opposite directions from a lock position to a maximum of two stations circumferentially spaced from the lock position. This stop washer technique for rotational control was used in conjunction with cylinder locks that employ a key-actuated plug rotatably mounted within a cylindrical housing. The plug typically retains a plurality of tumblers that are spring-biased into engagement with an accommodating spline on the inner surface of the housing to prevent rotation of the plug within the housing. Insertion of a properly bitted key into the plug draws the tumblers into shear positions and allows the plug to be rotated to other positions as controlled by the stop washers. However, this approach had the shortcoming that the direction of the plug rotation and therefore access to either operational station was at the discretion of the user possessing the single proper key.

More recently, a multistation lock was developed, U.S. Pat. Nos. 4,057,987 and 3,973,421, which used one or more wafer tumblers to control movement of a lock to different stations. Each station was controlled by a separate key which could not operate stations other than its own. With such an approach, however, one or more wafer tumblers are committed to the positional determination and so there is less space and fewer tumblers remaining to provide the locking combination. In addition, prior art locks have been quite susceptible to riffing and other techniques of illegal lock operation.

Locks of both wafer and pin type are subject to illicit manipulation by keys other than those proper to the lock being manipulated by a process known as riffing. Riffing consists of inserting other than the proper key in the keyway, applying light torque in the opening direction, and while maintaining torque moving the key axially in the plug. The action of the key profile in most cases causes the wafer to come to shear at various times during the action. As the wafer comes to shear the torque on the plug forces the edge of the wafer under the edge of the housing or shell spline. Continuing light torque maintains the wafer in that position while the repeated axial movement brings other wafers to shear, where they are in turn trapped. The trapping of each wafer provides a slight additional amount of angular motion of the plug, thus aiding the process.

Another common condition that exists in wafer locks is that of freedom of the key to be moved in a tilting manner in such a way as to lift the wafers in the unlocking direction to varied degrees. This motion is often used in conjunction with the axial movement of the key in riffing. Various means have been attempted with varying degrees of success to block such illicit action. It is particularly important that locks controlling electronic apparatus be secure from this type of tampering. Unauthorized entry into a particular station might reveal restricted data which should be available only to the station's rightful key holder. Further, such tampering could permit erasure of memory banks and provide opportunity for theft and embezzlement.

SUMMARY OF INVENTION

It is therefore an object of this invention to provide an improved multistation lock having a number of stations controllable by separate keys independent of tumbler mechanisms.

It is a further object of this invention to provide such a lock which has improved protection against operations such as riffing.

It is a further object of this invention to provide such a lock which uses tumbler mechanisms for directional control to enhance multistation operation.

The invention features a multistation lock including a housing and a plug rotatable in the housing between a lock position and first and second stations. There is a keyway in the plug and locking tumbler means for coupling the plug and housing. The locking tumbler means are biased into a locking position and are movable to a shear position by a proper key inserted in the keyway. A code track in the housing includes a different code segment for each station for engaging a coded section of a key shoulder. There is a first code segment for the first station for enabling a first key having a coded section receivable by the first code segment to move between the lock position and the first station, and a second code segment for the second station for enabling a second key having a coded section receivable by the second code segment to move between the lock position and the second station.

In one embodiment, the second station is beyond the first station in the same direction from the lock position, and the first and second code segments both receive the coded segment of the second key. In another embodiment, the first and second stations are in opposite directions from the lock position. The codes of the key code sections and track code segments may be arranged so that each code segment receives the code section of its corresponding key and each key that must move through it to reach its own station, but no other key. Alternatively, there may be directional tumbler means, for coupling the plug and housing, which are biased to prevent rotation in one direction and moveable by a proper key in the keyway to a shear position to enable rotation in the other direction.

An anti-theft member may be provided at the inner end of the keyway for engaging the tip of the key and preventing tilting of the key. The locking tumbler means may include a plurality of spaced tumblers and the anti-lift member may include an anti-lift surface. The key engaging with the anti-lift member may have a salient element at its tip for engaging the anti-lift member. Key means may be provided including at least two keys each having a different shoulder coded section.

In preferred embodiments the lock may also include a third station and a third code segment for enabling a third key having a coded section receivable by the third code segment to move between the lock portion and the third station through at least one of the first and second stations and the associated code segment, which receives the code section of the third key. There may also be a fourth station and a fourth code segment for enabling a fourth key having a code section receivable by the fourth code segment to move between the lock position and the fourth station through at least one of the first, second and third stations and the associated code segment which receives the code section of the fourth key.

DISCLOSURE OF PREFERRED EMBODIMENT

Other objects, features and advantages will occur from the following description of a preferred embodiment and the accompanying drawings, in which.

Figure 1:
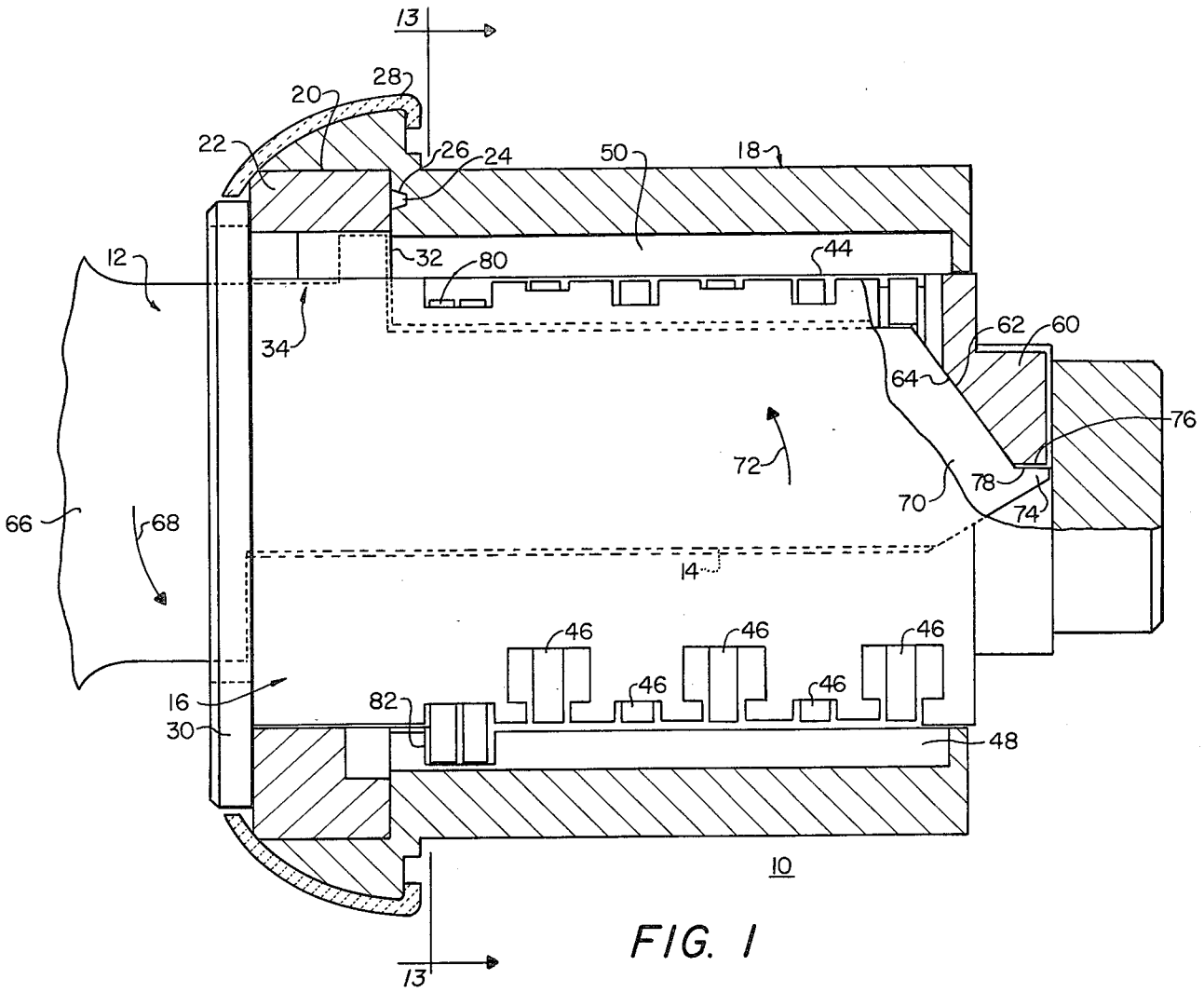
FIG. 1 is a side elevational view in cross section of a multistation lock according to this invention with a key inserted in the keyway of the plug.

There is shown in FIG. 1 a multistation lock 10 according to this invention including key 12 inserted in keyway 14 of plug 16 rotatably mounted in shell or housing 18. Housing 18 includes a counterbore, recess 20, which receives annular code track 22 fixed against rotation by studs 24 received in holes 26 at the base of counterbore 20. Code track 22 is secured in position by scalp 28 which terminates at the forward end of housing 18 proximate head 30 of plug 16. The key stop 32 in lock 10 is recessed within plug 16 in contrast to the key stop's normal position at head 30. In order to accommodate the code section of key 12, code track 22 has a number of code segments, each having a different coded cross-sectional configuration for receiving one or more keys 12, each having a different code section 34. Thus each code segment of code track 22 accepts one or more code sections 34 from different keys 12 and rejects code sections on other keys, as will be explained subsequently.

Figure 2:
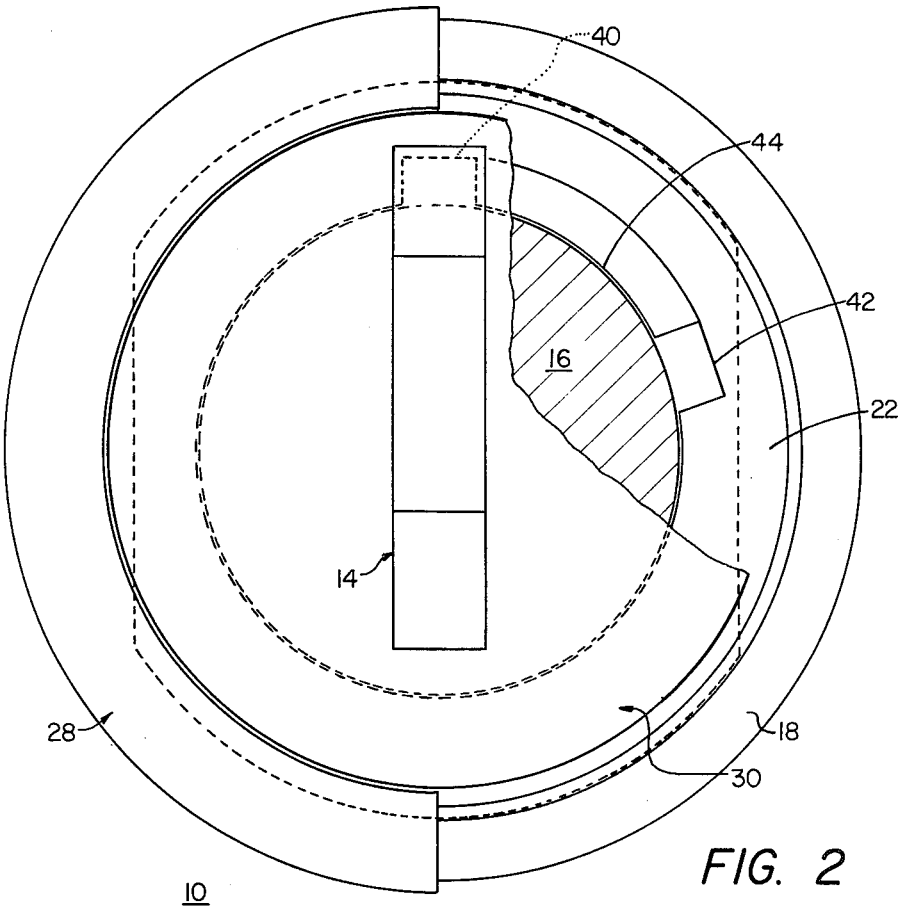
FIG. 2 is a front elevational view of the lock of FIG. 1 with portions of the scalp and head removed.

Code track 22 also includes slots 40 and 42, FIG. 2, which permit a key 12 bearing a code section 34 to be inserted and withdrawn but prevent rotation of such a key except if it is provided with the proper code section 34.

Figure 3:
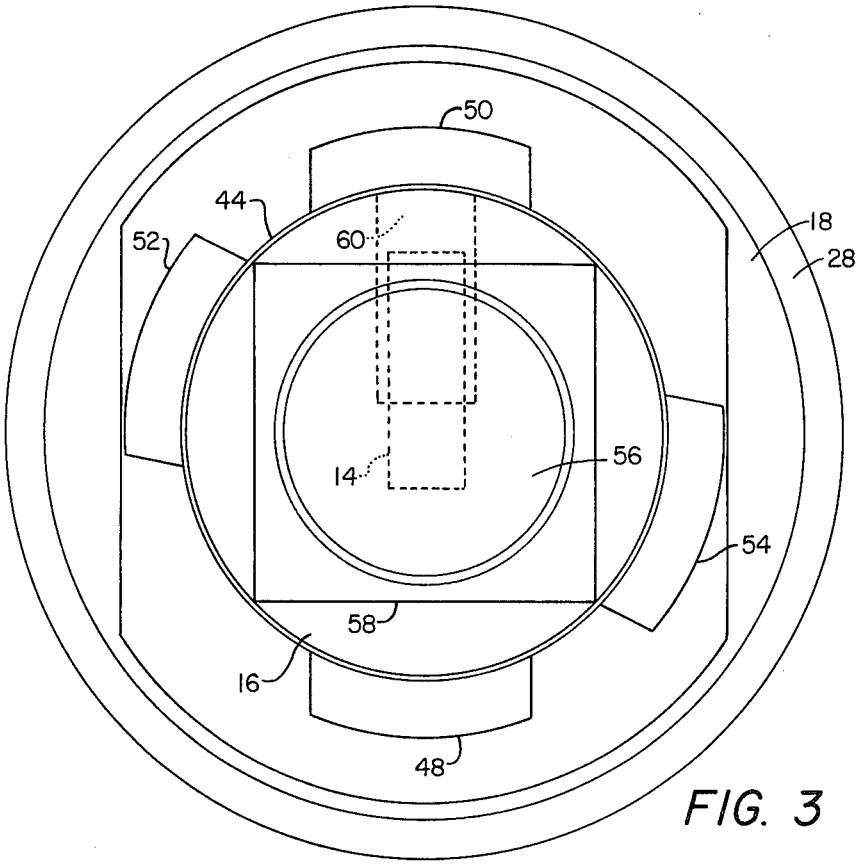
FIG. 3 is a rear elevational view of the lock of FIG. 1.

Plug 16 rotatable in bore 44, FIG. 1, of housing 18, includes a set of five combinating or locking tumblers 46 which are normally biased into spline 48 of housing 18 to prevent rotation of plug 16, but are drawn to shear by the insertion of a properly bitted key 12 which reads wafers 46. A second spline 50 is positioned diametrically opposite spline 48 in the usual manner. Another spline 52, FIG. 3, is also provided in the position corresponding to that of slot 42, FIG. 2, and spline 52 has a corresponding, diametrically opposed spline 54, FIG. 3. The inner end of plug 16 includes chamfered circular stud 56 and square lug 58. Also provided at the inner end of plug 16 is an anti-tampering or lifting insert or member 60, which includes a sloping forward surface 62, FIG. 1, which snugly fits with the sloping forward surface 64 of key 12 to prevent tilting of key 12 caused by tilting the head 66 of key 12 downwardly as indicated by arrow 68, and the tip 70 of key 12 upwardly as indicated by arrow 72. Further protection against such tilting can be accomplished by providing an elongate or salient member 74 at the tip of key 70, enabling it to bear on the lower surface 76 of member 60, so that surface 76 acts as a ceiling to hold down the generally longitudinally extending shelf 78 created on the top of salient member 74. Shelf 78 is of sufficient length that it will stay in engagement with surface 76 until there has occurred sufficient longitudinal movement of the key to cause misalignment between the key bits and their corresponding tumblers.

Plug 16 also includes a pair of directional control wafers 80 which normally extend into spline 48 adjacent partially circumferential slot 82, which permits plug 16 to be rotated clockwise but not counterclockwise unless a key with the proper bit is inserted to draw control wafers 80 to shear, as will be explained subsequently.

Figure 4:
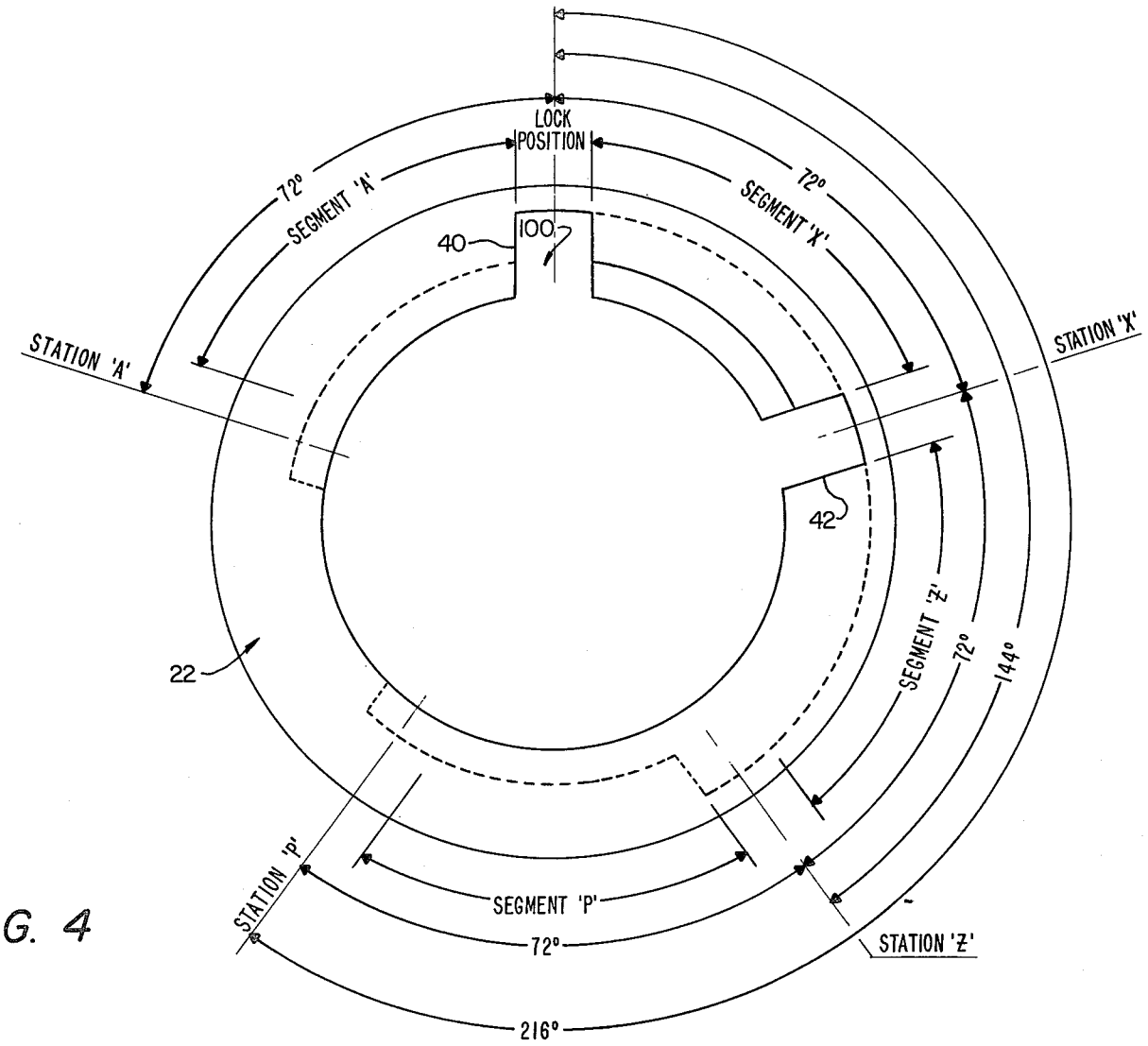
FIG. 4 is a front elevational view of the code track of FIG. 1.

Code track 22, FIG. 4, includes four code segments: segment A, segment X, segment Z and segment P. Segment A extends from lock position 100 counterclockwise to station A. Code segment X extends clockwise from lock position 100 to station X. Segment Z extends further clockwise from station X to station Z, and segment P extends further clockwise from station Z to station P. Directional wafers 80, FIG. 1, prevent counterclockwise rotation to station A except when the properly bitted key draws directional wafers 80 to shear. Otherwise all of the keys are permitted only to rotate clockwise in the direction of stations X, Z, and P independent of the allowable direction of rotation as dictated by directional wafers 80. The key will be enabled to move to a particular station only if the code section on the shoulder of that key can be received by each of the code segments of code track 22 which extend between the lock position and the particular station desired to be operated by that key.

Figure 5:
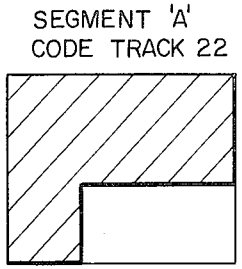
FIG. 5 is a cross-sectional view of code segment A of the code track.
Figure 6:
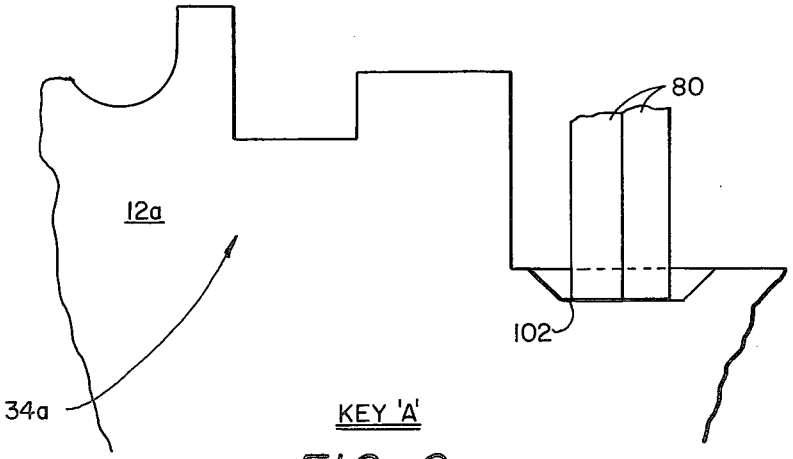
FIG. 6 is a side view of a portion of key A which is received by code segment A of the code track of FIG. 5.

Segment A of code track 22 has the profile illustrated in FIG. 5. Thus it will receive code section 34*a*, FIG. 6, of key 12*a* and enable key 12*a* to rotate from lock position 100 to station A, FIG. 4, provided that key 12*a* also has the proper bit 102 to lift directional wafers 80 to shear and enable them to clear stops which otherwise prevent counterclockwise rotation of key 12*a*. Segment X of code track 22 has the profile illustrated in FIG. 7. Thus it receives code section 34*x*, FIG. 8, on key 12*x*.

Figure 7:
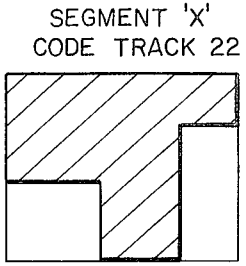
FIG. 7 is a cross-sectional view of code segment X of the code track.
Figure 8:
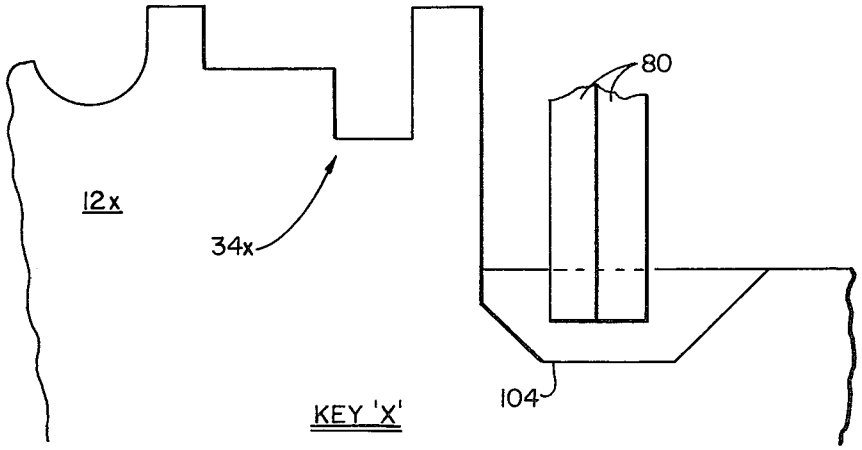
FIG. 8 is a side view of a portion of key X which is received by code segment X of the code track of FIG. 7.
Figure 11:
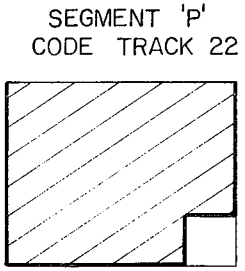
FIG. 11 is a cross-sectional view of code segment P of the code track.
Figure 12:
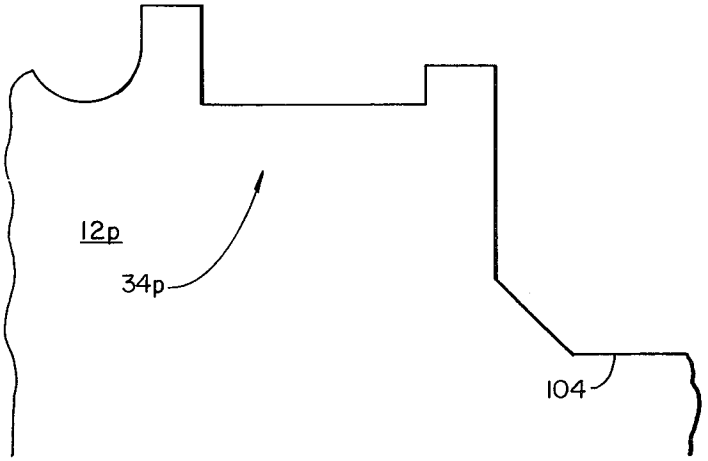
FIG. 12 is a side view of a portion of key P which is received by code segment P of the code track of FIG. 11.
Figure 9:
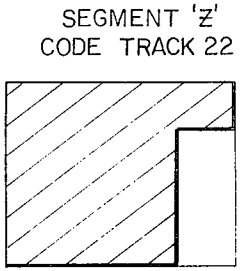
FIG. 9 is a cross-sectional view of code segment Z of the code track.
Figure 10:
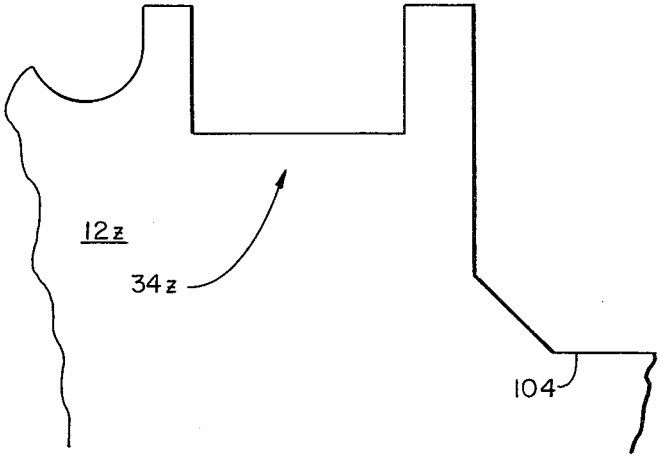
FIG. 10 is a side view of a portion of key Z which is received by code segment Z of the code track of FIG. 9.

Key 12*x* contains bit 104, which is cut too low to lift directional wafers 80 and so key 12*x* is not enabled to rotate in the counterclockwise direction. The remaining keys 12*z* and 12*p* also contain a bit such as 104, which do not enable them to lift directional wafers 80 to shear. In addition, the profile of segment X, FIG. 7, is such as to prevent it from receiving code section 34*a* of key 12*a*, FIG. 6, and the profile of segment A, FIG. 5, is such as to prevent it from receiving code section 34*x* of key 12*x*, FIG. 8. Segment Z of code track 22, FIG. 9, has the profile illustrated in FIG. 9 so that it may receive code section 34*z*, FIG. 10, of key 12*z*. In addition, the configuration of code section 34*z* enables it to pass through not only code segment Z, FIG. 9, but also through code segment X, FIG. 7, so that key 12*z* may move from lock position 100 through station X to station Z. Segment P of code track 22 is illustrated in FIG. 11 having a profile which can receive code section 34*p*, FIG. 12, of key 12*p*. In addition, code section 34*p* is configured so that it will also be received in segment Z and segment X of code track 22 so that key 12*p* is enabled to move from lock position 100 through segment X, station X, segment Z, station Z, and segment P, to arrive finally at station P.

Figure 15:
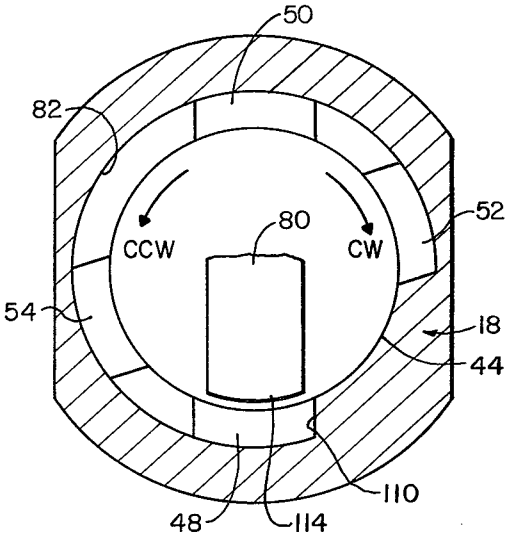
FIG. 15 is a view similar to FIG. 14 with the directional wafer tumbler drawn to shear to permit counterclockwise rotation.
Figure 14:
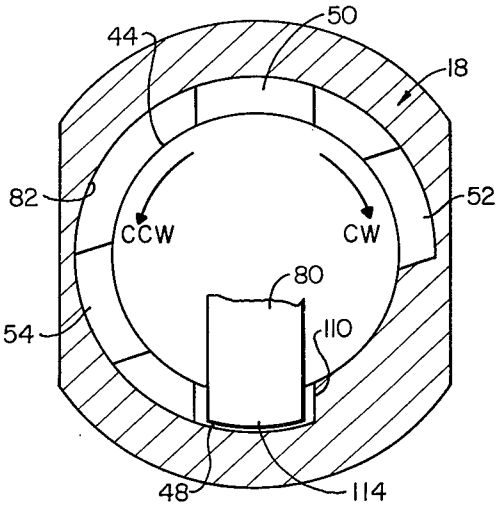
FIG. 14 is a view similar to FIG. 13 with the directional wafer tumbler locked against counterclockwise rotation.
Figure 13:
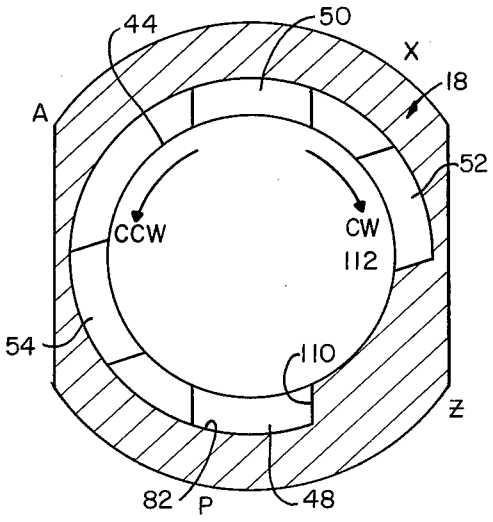
FIG. 13 is a sectional view along line 13—13 of FIG. 1.

Circumferential slot 82, which provides for motion of directional wafers 80, FIG. 14, is provided with two stops, a counterclockwise stop 110 and clockwise stop 112, between which an entire circumferential slot extends. With directional wafers 80 in the normal position biased down into spline 48, their lower end 114 abuts stop 110 and prevents counterclockwise rotation of plug 16. However, with the full extent of circumferential slot 82 available from stop 110 around in a clockwise direction to stop 112, plug 16 is fully able to rotate in a clockwise direction until lower end 114 of directional wafers 80 hits clockwise stop 112. When the proper key is inserted, having bit 102, such as key 12*a*, FIG. 6, directional wafers 80 may be brought to shear, FIG. 15, so that their lower end 114 clears counterclockwise stop 110 and permits plug 16 to be rotated in the counterclockwise direction so that station A may be accessed.

The multistation lock of this invention provides increased security in two aspects. First, the withdrawal of key 12, FIG. 1, a sufficient amount to withdraw salient member 74 from beneath ceiling 76 in order to attempt riffing to raise locking disks 46 out of spline 48, is defeated because by the time member 74 is withdrawn from under ceiling 76, the bits on the key are misaligned with the corresponding tumblers.

Second, an attempt to bring locking wafers 46 to shear by riffing, that is the simultaneous application to the key of rotational torque and axial oscillation, results in the code track being misaligned so that even if the locking wafer combination can be illicitly read the code track will block the misaligned code section and prevent the key from rotating.

The use of a directional tumbler to control the direction of rotation of a key with respect to one or more stations is not a necessary limitation of the invention, as the code track itself may act as a directional control on the key code sections. For example, in this embodiment the X key code section cannot pass through code segment A and the A key code section cannot apass through code segment X notwithstanding the function of the directional tumbler. The key code sections Z and P can pass through code segments X and A, but could be made so that they cannot pass through code segment A. The use of a directional tumbler eases the design problem and makes available more spatial codes.

Other embodiments will occur to those skilled in the art and are within the following claims:

What is claimed is:

1. A multistation lock comprising:

a housing;

a plug rotatable in said housing between a lock position and first and second stations;

a keyway in said plug;

locking tumbler means for coupling said plug and housing and being biased into a locking position and being movable to a shear position by a proper key in said keyway;

stop means disposed in said housing for blocking rotation of said plug in said housing when said locking tumbler means are in the locking position; and a code track in said housing, said track having a different code segment for each station for receiving a code section of a key shoulder, each code segment extending between said lock position and an associated station and having a cross sectional profile which receives a code section of a key shoulder of a properly fitting key and which directly encounters and blocks the key shoulder code section of other keys, including a first code segment extending between said lock position and said first station for enabling a first key having a code section receivable by said first code segment to move between said lock position and said first station, and a second code segment extending between said lock position and said second station for enabling a second key having a code section receivable by said second code segment to move between said lock position and said second station.

2. The multistation lock of claim 1 in which said second station is beyond said first station in the same direction from said lock position and said first and second code segments both receive the coded section of the second key and not the first key.

3. The multistation lock of claim 1 in which said first and second stations are in opposite directions from said lock position.

4. The multistation lock of claim 1 in which said first code segment does not receive the code section of the second key and said second code segment does not receive the code section of the first key.

5. The multistation lock of claim 1 further including directional tumbler means for coupling said plug and housing and biased to prevent rotation in one direction and being movable by a proper key in said keyway to a shear position to enable rotation in the other direction.

6. The multistation lock of claim 1 further including an anti-lift member at the inner end of said keyway for engaging the tip of a key and preventing tilting of the key.

7. The multistation lock of claim 6 in which said locking tumbler means includes a plurality of spaced tumblers and said anti-lift member includes an anti-lift surface for engaging a complementary surface on said key and preventing lifting of said key.

8. The multistation lock of claim 1 further including key means including at least two keys each having a different shoulder coded section.

9. The multistation lock of claim 6 further including a key having a salient element at its tip engaging said anti-lift member.

10. The multistation lock of claim 1 further including a third station and a third code segment extending between said lock position and said third station for enabling a third key having a coded section receivable by said third code segment to move between the lock position and said third station through at least one of said first and second stations and the associated code segment which receives the code section of the third key.

11. The multistation lock of claim 10 in which said third code segment does not receive the code sections of the first and second keys.

12. The multistation lock of claim 10 further including a fourth station and a fourth code segment extending between said lock position and said fourth station for enabling a fourth key having a coded section receivable by said fourth code segment to move between the lock position and said fourth station through at least one of said first, second and third stations and the associated code segment which receives the code section of the fourth key.

13. The multistation lock of claim 12 in which said fourth code segment does not receive the code segments of the first, second and third keys.

14. A multistation lock comprising:

a housing;

a plug rotatable in said housing between a lock position and first, second and third stations;

a keyway in said plug;

locking tumbler means for coupling said plug and housing and being biased into a locking position and being movable to a shear position by a proper key in said keyway;

stop means disposed in said housing for blocking rotation of said plug in said housing when said locking tumbler means are in the locking position; and a code track in said housing, said track having a different code segment for each station for receiving a code section of a key shoulder, each code segment extending between said lock position an associated station and having a cross sectional profile which receives a code section of a key shoulder of a properly fitting key and which directly encounters and blocks the key shoulder code section of other keys, including a first code segment extending between said lock position and said first station for enabling a first key having a code section receivable by said first code segment to move between said lock position and said first station, and a second code segment extending between said lock position and said second station for enabling a second key having a code section receivable by said second code segment to move between said lock position and said second station, and a third code segment extending between said lock position and said third station for enabling a third key having a code section receivable by said third code segment to move between said lock position and said third station through at least one of said first and second stations and the associated code segment which receives the code section of the third key.

15. A multistation lock comprising:

a housing;

a plug rotatable in said housing between a lock position and first, second and third stations;

a keyway in said plug;

locking tumbler means for coupling said plug and housing and being biased into a locking position and being movable to a shear position by a proper key in said keyway;

stop means disposed in said housing for blocking rotation of said plug in said housing when said locking tumbler means are in the locking position; and a code track in said housing, said track having a different code segment for each station for engaging a code section of a key shoulder, each code segment extending between said lock position and an associated station and having a cross sectional profile which receives a code section of a key shoulder of a properly fitting key and which directly encounters and blocks the key shoulder code section of other keys, including a first code segment extending between said lock position and said first station for enabling a first key having a code section receivable by said first code segment to move between said lock position and said first station; a second code segment extending between said lock position and said second station for enabling a second key having a code section receivable by said second code segment to move between said lock position and said second station; a third code segment extending between said lock position and said third station for enabling a third key having a code section receivable by said third code segment to move between said lock position and said third station through at least one of said first and second stations and the associated code segment which receives the code section of the third key, and a fourth code segment extending between said lock position and said fourth station for enabling a fourth key having a code section receivable by said fourth code segment to move between said lock position and said fourth station through at least one of said first, second and third stations and the associated code segment which receives the code section of the fourth key.

16. A multistation lock comprising:

a housing;

a plug rotatable in said housing between a lock position and a first station in one direction and second and third stations in the other direction;

a keyway in said plug;

locking tumbler means for coupling said plug and housing and being biased into a locking position and being movable to a shear position by a proper key in said keyway;

stop means disposed in said housing for blocking rotation of said plug in said housing when said locking tumbler means are in the locking position; and a code track in said housing, said track having a different code segment for each station for receiving a code section of a key shoulder, each code segment extending between said lock position and an associated station and having a cross sectional profile which receives a code section of a key shoulder of a properly fitting key and which directly encounters and blocks the key shoulder code section of other keys including a first code segment extending between said lock position and said first station for enabling a first key having a code section receivable by said first code segment to move between said lock position and said first station; a second code segment extending between said lock position and said second station for enabling a second key having a code section receivable by said second code segment to move between said lock position and said second station, a third code segment extending between said lock position and said third station for enabling a third key having a code section receivable by said second and third code segments to move between said lock position and said third station through said second station, and a fourth code segment extending between said lock position and said fourth station for enabling a fourth key having a code section receivable by said second, third and fourth code segments to move between said lock position and said fourth station through said second and third stations.

17. The multistation lock of claim 13 further including directional tumbler means for coupling said plug and housing and being biased to prevent rotation in one direction and being movable by a proper key in said keyway to a shear position to enable rotation in the other direction.

* * * * *